US007931037B1

(12) United States Patent
Ryan

(10) Patent No.: US 7,931,037 B1
(45) Date of Patent: Apr. 26, 2011

(54) COVERING SYSTEM

(76) Inventor: Jason S. Ryan, Byron, MN (US)

( * ) Notice: Subject to any disclaimer, the term of this patent is extended or adjusted under 35 U.S.C. 154(b) by 25 days.

(21) Appl. No.: 12/392,843

(22) Filed: Feb. 25, 2009

(51) Int. Cl.
*E04H 15/58* (2006.01)

(52) U.S. Cl. ..... 135/117; 135/121; 135/160; 135/118; 135/119; 160/24; 52/63

(58) Field of Classification Search ..... 135/87, 135/121, 157, 160, 117–119, 120.3, 143; 160/351, 265, 24; 52/2.25, 67–68, 122.1; 47/29.5, 29.6
See application file for complete search history.

(56) References Cited

U.S. PATENT DOCUMENTS

| | | | | |
|---|---|---|---|---|
| 1,283,452 | A * | 11/1918 | Bardin | 47/29.6 |
| 2,886,047 | A * | 5/1959 | Healy | 135/95 |
| 2,995,137 | A * | 8/1961 | Cothern | 135/88.08 |
| 3,741,224 | A * | 6/1973 | Clelland | 135/87 |
| 4,000,585 | A * | 1/1977 | Denaro | 52/2.17 |
| 4,068,404 | A | 1/1978 | Sheldon | |
| 5,117,853 | A * | 6/1992 | Pruesner | 135/121 |
| 5,613,543 | A * | 3/1997 | Walton | 160/265 |
| 5,791,363 | A * | 8/1998 | Moses | 135/143 |
| D413,679 | S | 9/1999 | Lester | |
| 6,325,085 | B1 * | 12/2001 | Gower | 135/90 |
| RE37,498 | E | 1/2002 | Thomas | |
| 6,345,638 | B1 | 2/2002 | Warner | |
| 6,779,537 | B1 * | 8/2004 | Miller | 135/117 |
| 7,240,890 | B1 * | 7/2007 | Pellegrino | 248/503 |
| 7,290,553 | B2 * | 11/2007 | Prevost | 135/143 |
| 2004/0261953 | A1 | 12/2004 | Hart | |

FOREIGN PATENT DOCUMENTS

| | | |
|---|---|---|
| EP | 0837195 | 4/1998 |
| WO | WO2004/113635 | 12/2004 |

* cited by examiner

*Primary Examiner* — Winnie Yip
(74) *Attorney, Agent, or Firm* — Neustel Law Offices

(57) ABSTRACT

A covering system for efficiently and quickly sheltering a plurality of vehicles, objects or other structures from hail or other damaging elements. The covering system generally includes a pair of connecting stations embedded below a ground surface, wherein the pair of connecting stations are aligned with each other and distally separated, a pair of end frames connected to the pair of connecting stations and a canopy interposed between the pair of end frames, wherein the canopy is connected to the pair of connecting stations via the pair of end frames. The canopy includes a pair of wings foldably connected near an apex of the canopy to form a triangular shaped configuration for sheltering a structure beneath.

18 Claims, 7 Drawing Sheets

COVERING SYSTEM

CROSS REFERENCE TO RELATED APPLICATIONS

Not applicable to this application.

STATEMENT REGARDING FEDERALLY SPONSORED RESEARCH OR DEVELOPMENT

Not applicable to this application.

BACKGROUND OF THE INVENTION

1. Field of the Invention

The present invention relates generally to quick set-up shelters and more specifically it relates to a covering system for efficiently and quickly sheltering a plurality of vehicles, structures, or objects from hail or other damaging elements.

2. Description of the Related Art

Any discussion of the related art throughout the specification should in no way be considered as an admission that such related art is widely known or forms part of common general knowledge in the field.

Automobile dealers are popular in many geographic areas of the world, and generally operate by parking all of their vehicles in an open-air lot where the vehicles are exposed to the weather and other damaging elements. When inclement weather occurs, such as but not limited to snowstorms, hailstorms, excessive heat, etc., the vehicles can often times be damaged thus substantially decreasing the fair market value of the vehicles for the automobile dealer and many times causing hassle and a large amount of profits lost.

Automobile dealers have tried to at least partially offset damages caused by weather elements in various ways. One such way is through the use of protective insurance for the vehicles. However, these rates can often times be high, and along with expensive premiums, and other associated hassles, can end up costing the automobile dealer large sums of money and amounts of time even with an insurance payout.

Another method of protecting the vehicles is to try to move the vehicles indoors during or prior to inclement weather. However, the dealership is only able to move some vehicles indoors, wherein they generally do not have enough room to accommodate all of their vehicles. In addition, many times there is not suitable warning for the dealer prior to the storm to give them adequate time to move the vehicles before damage occurs.

A structure for providing a quick setup shelter is needed in various other areas as well as in the automobile industry, such as in construction areas, where it may be necessary at times to quickly cover wet cement to prevent damage of the cement from weather elements. Because of the inherent problems with the related art, there is a need for a new and improved covering system for efficiently and quickly sheltering a plurality of vehicles, structures, or objects from hail or other damaging elements.

BRIEF SUMMARY OF THE INVENTION

The general purpose of the present invention is to provide a covering system that has many of the advantages of the car covers mentioned heretofore. The invention generally relates to a car cover which includes a pair of connecting stations embedded below a ground surface, wherein the pair of connecting stations are aligned with each other and distally separated, a pair of end frames connected to the pair of connecting stations and a canopy interposed between the pair of end frames, wherein the canopy is connected to the pair of connecting stations via the pair of end frames. The canopy includes a pair of wings foldably connected near an apex of the canopy to form a triangular shaped configuration for sheltering a structure beneath.

There has thus been outlined, rather broadly, some of the features of the invention in order that the detailed description thereof may be better understood, and in order that the present contribution to the art may be better appreciated. There are additional features of the invention that will be described hereinafter and that will form the subject matter of the claims appended hereto.

In this respect, before explaining at least one embodiment of the invention in detail, it is to be understood that the invention is not limited in its application to the details of construction or to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

An object is to provide a covering system for efficiently and quickly cover a plurality of vehicles, such as in a car lot, to protect the vehicles from hail or other damaging elements.

An object is to provide a covering system for efficiently and quickly sheltering various types of objects, shelters, or vehicles beneath.

Another object is to provide a covering system that may be removed and stored during non-use.

An additional object is to provide a covering system that may be setup quickly and easily with minimal effort.

A further object is to provide a covering system that is retractable so as to allow for easy storage and transportation.

Another object is to provide a covering system that is comprised of a material that reduces wind resistance allowing the cover to be lighter while maintaining the strength needed to protect the enclosed vehicles.

Other objects and advantages of the present invention will become obvious to the reader and it is intended that these objects and advantages are within the scope of the present invention. To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

A. Overview

Figure 1:
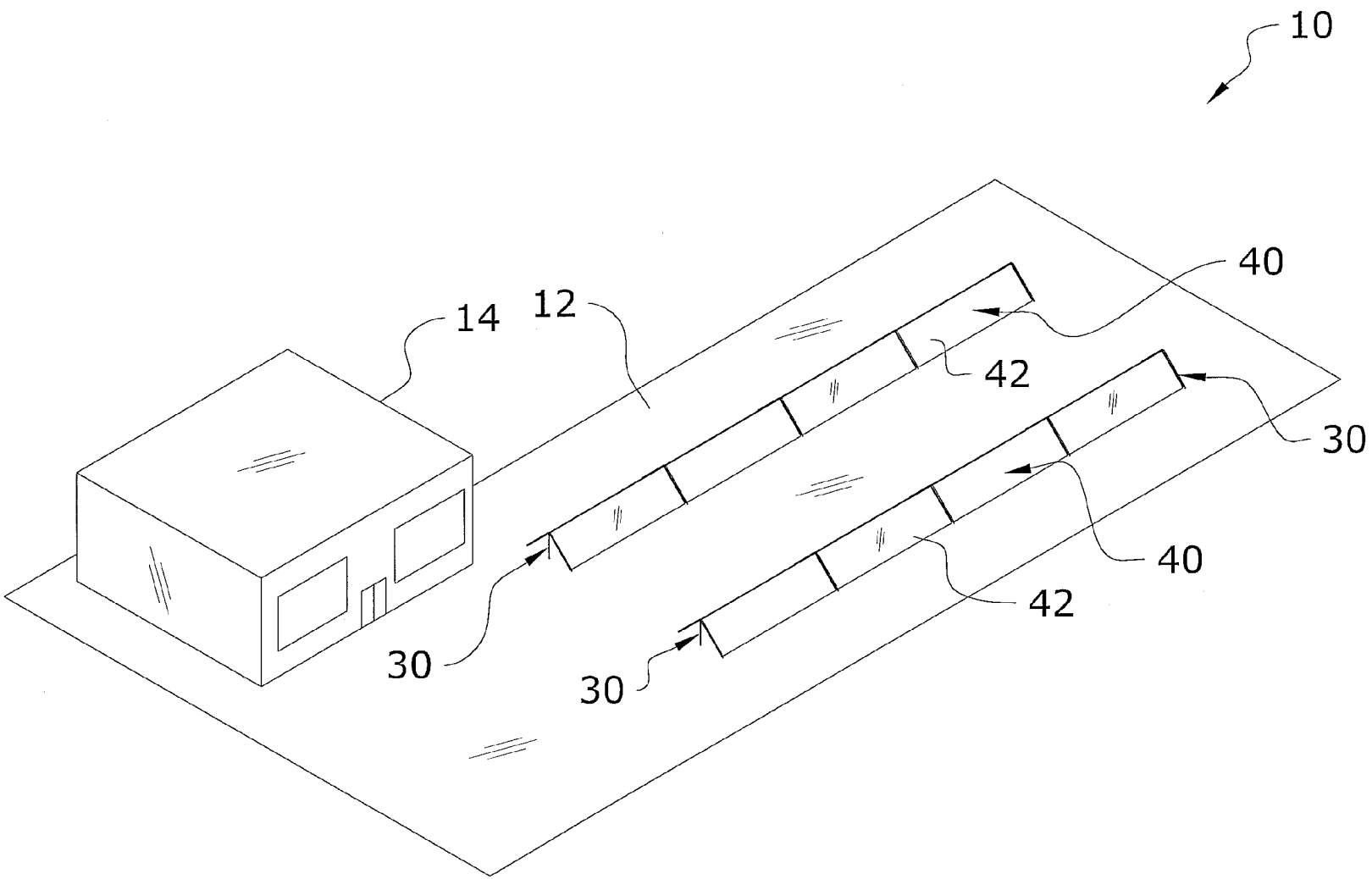
FIG. 1 is an upper perspective view of the present invention setup at a vehicle dealership, wherein a plurality of end frames and canopies are connected together to enclose a plurality of vehicles beneath.
Figure 2:
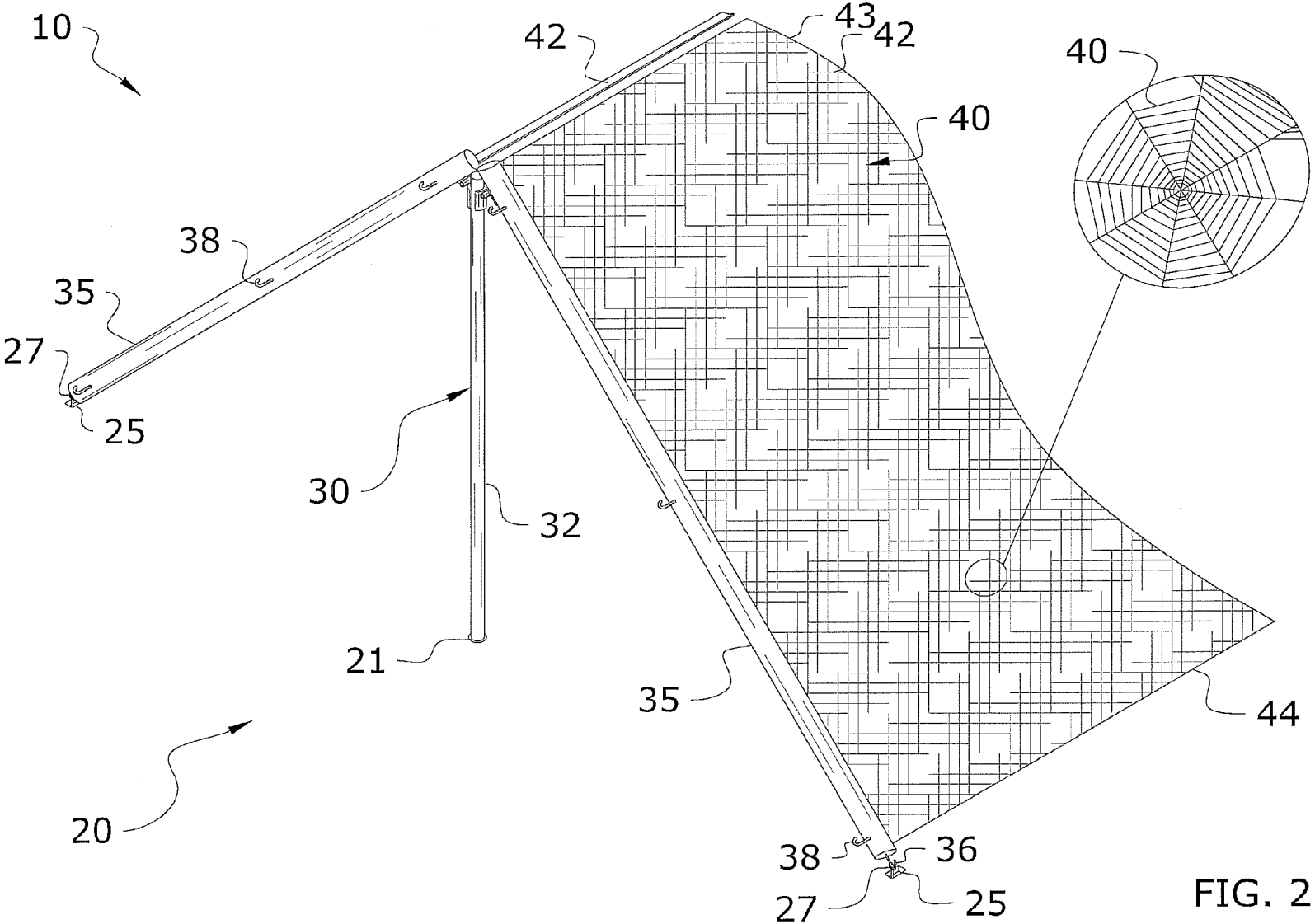
FIG. 2 is an upper perspective view of the end frame a portion of the canopy, wherein part of the canopy is exploded to show an embodiment of a stitching pattern.
Figure 3:
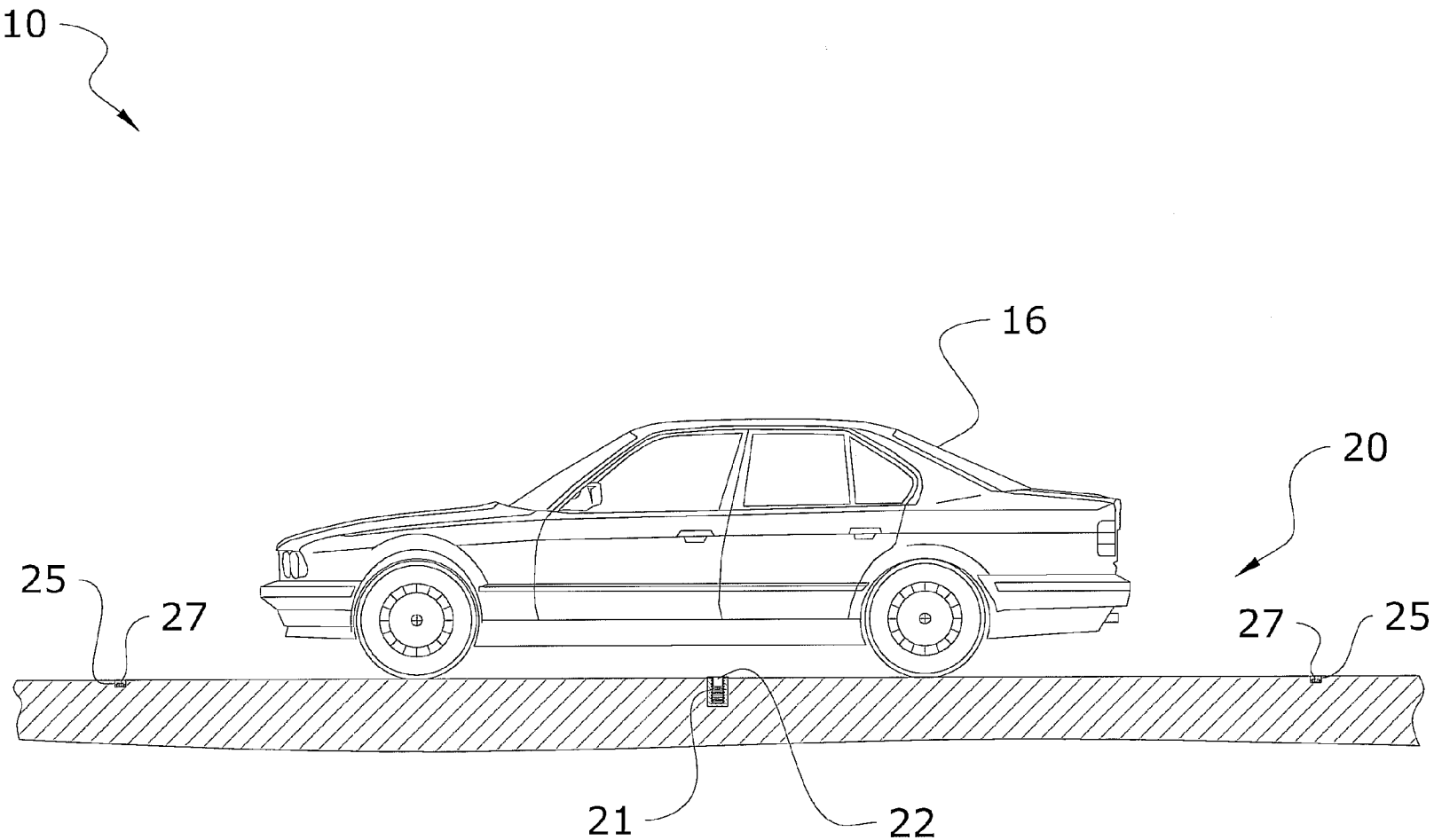
FIG. 3 is a front sectional view showing a vehicle centered over a connecting station.
Figure 4:
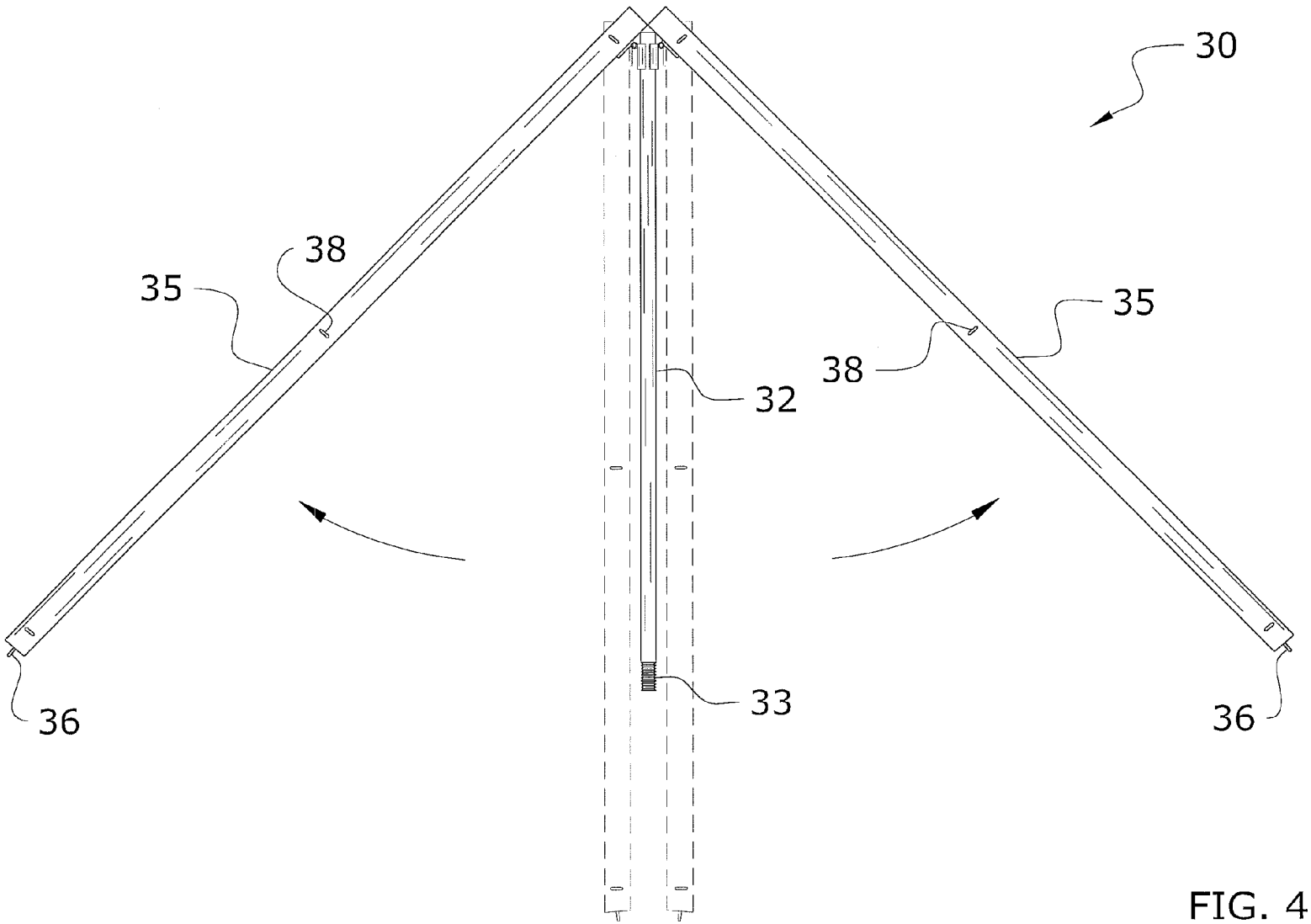
FIG. 4 is a front view of the present invention showing the end frame pivoting outwards from a storage position to an in use position.
Figure 5:
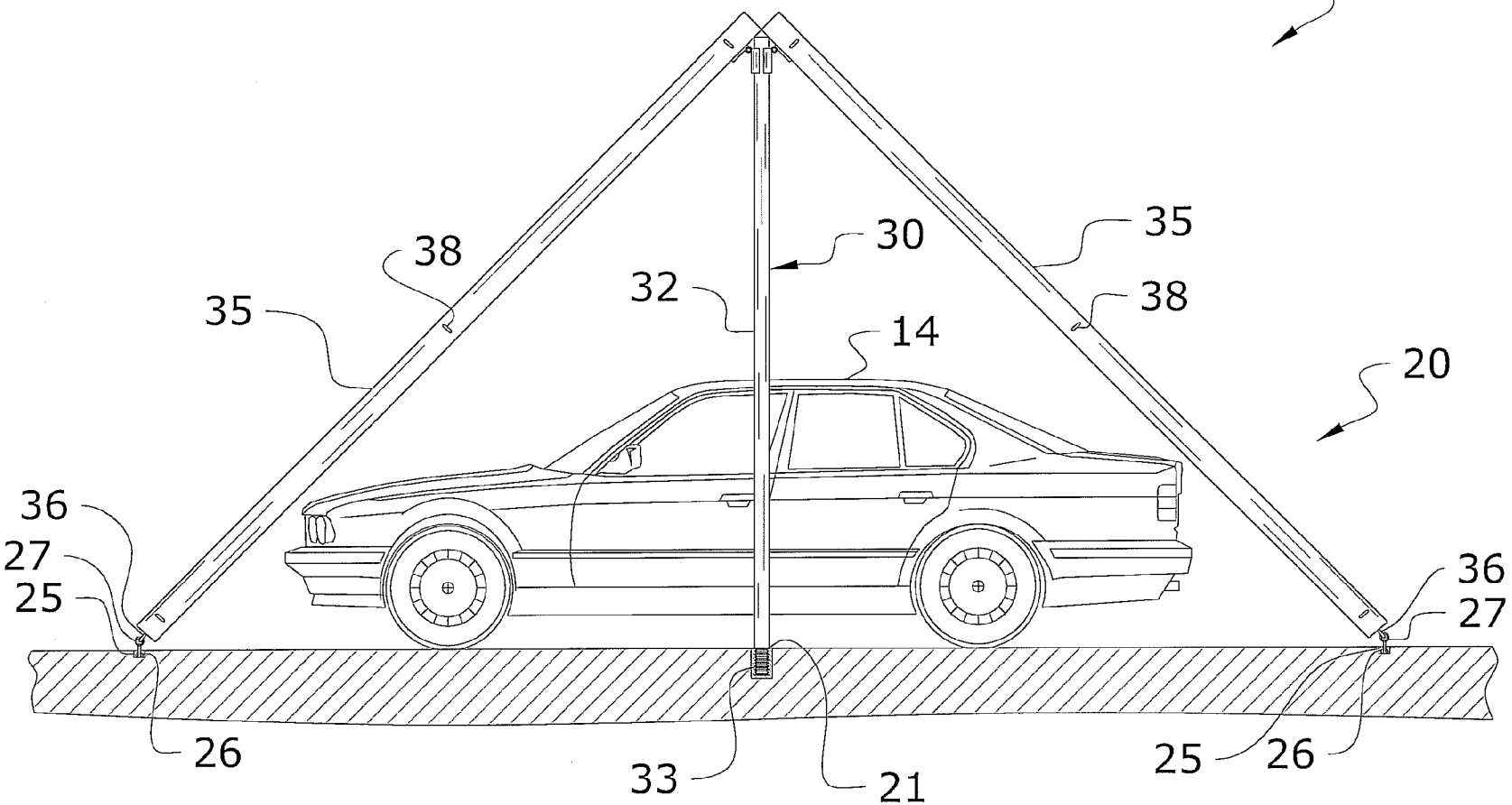
FIG. 5 is a front view of the present invention enclosing a vehicle beneath.
Figure 6:
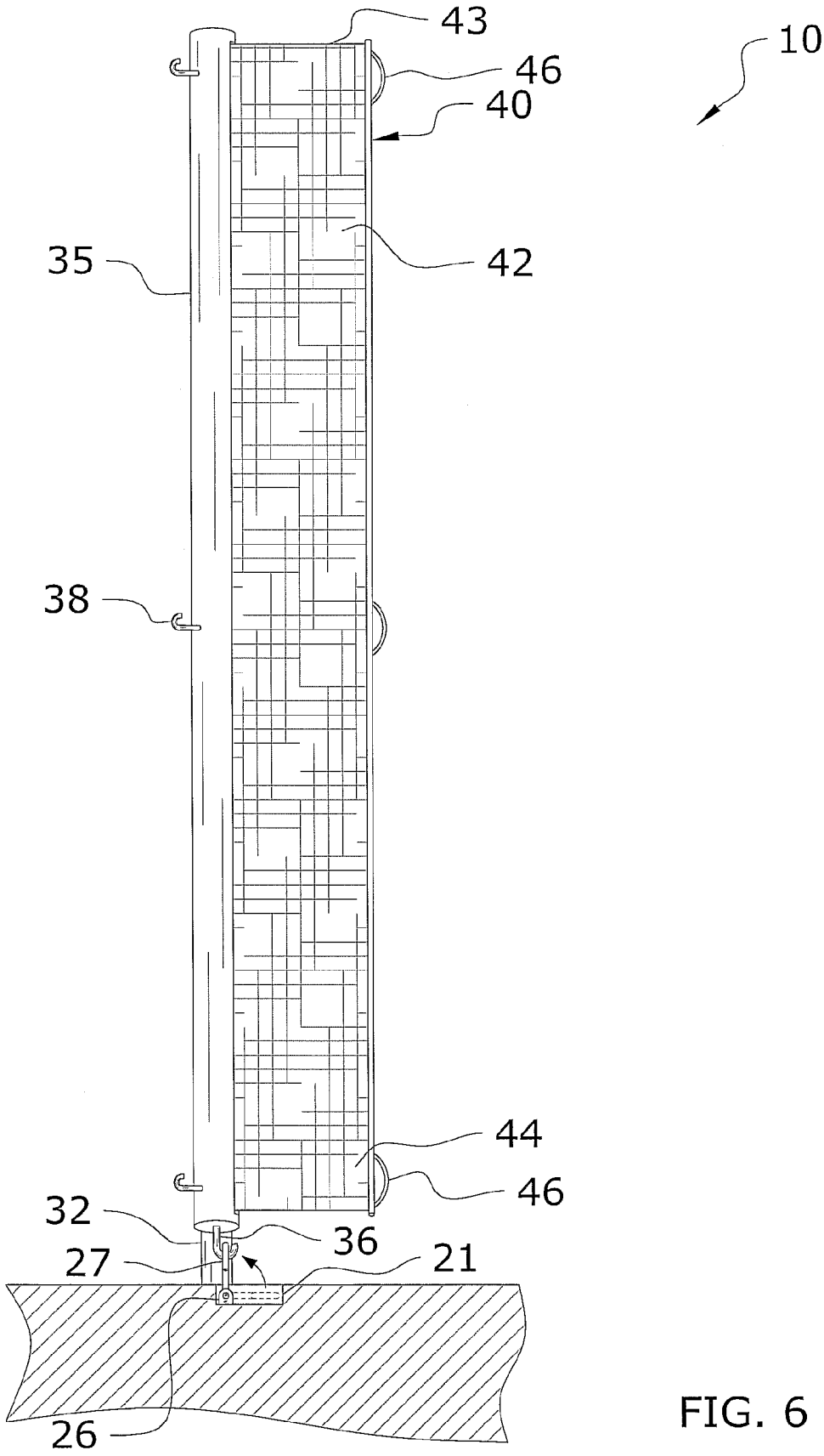
FIG. 6 is a side view of the present invention showing the wing partially extended outwards from the arm, wherein a majority of the wing is rolled-up within the arm.
Figure 7:
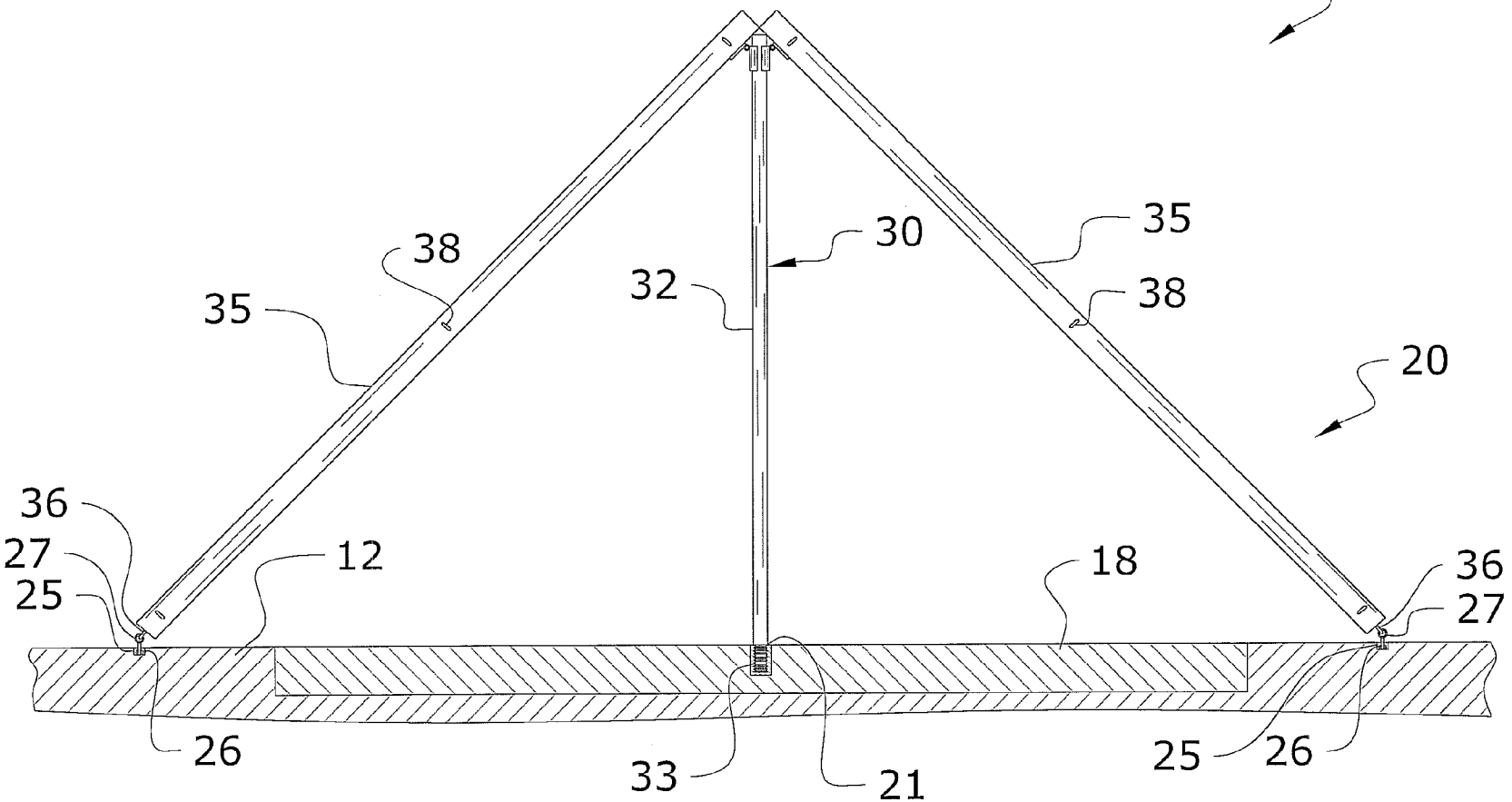
FIG. 7 is a front view of the present invention sheltering wet cement beneath.

Turning now descriptively to the drawings, in which similar reference characters denote similar elements throughout the several views, FIGS. 1 through 7 illustrate a covering system 10, which comprises a pair of connecting stations 20 embedded below a ground surface of a vehicle lot 12, wherein the pair of connecting stations 20 are aligned with each other and distally separated, a pair of end frames 30 connected to the pair of connecting stations 20 and a canopy 40 interposed between the pair of end frames 30, wherein the canopy 40 is connected to the pair of connecting stations 20 via the pair of end frames 30. The canopy 40 includes a pair of wings 42 foldably connected near an apex of the canopy 40 to form a triangular shaped configuration for enclosing a vehicle 16 beneath.

B. Vehicle Lot

The present invention is generally used to shelter a plurality of vehicles, such as automobiles, motorcycles, campers, boats, etc., within a vehicle lot 12, automobile dealership 14 or open space to protect the vehicles from damaging weather elements, such as hail, sun, snow, etc. The present invention is further generally utilized in open-air vehicle lots 12 that have a plurality of vehicles exposed to the weather elements. The vehicle lots 12 may be paved, graveled or have various other types of ground surfaces. It is appreciated however that the present invention may be used to shelter a single vehicle or other objects as desired, other than those in a vehicle lots, such as construction projects (e.g. wet cement 18 upon a ground surface 12 as in FIG. 7, etc.) or any structure (e.g. ground surface, object, etc.) that is desired to be sheltered from above. Thus, the term vehicle lot or vehicle described herein is not meant to be limiting in any manner.

To accommodate the present invention, the vehicle lots 12 generally have plurality of connecting stations 20 located at points that are suitable to connecting to the end frames 30. The connecting stations 20 are distally spaced apart so as to fit several vehicles between them. The connecting stations 20 are also generally aligned or positioned in a manner to conform to the length and shape of the canopy 40 and end frames 30.

The connecting stations 20 generally include a center opening 21 that is threadably formed. During non-use, to prevent buildup or debris from accumulating within the center opening 21, a plug 22 may be secured within. It is appreciated that the plug 22 is level with or below the surface of the vehicle lot 12 when positioned within the opening to be out of the way of customers, moving vehicles, etc.

A pair of outer slots 25 are positioned upon each side of the center opening 21 at a distance from the center opening 21 generally equal or greater to the average half length of a vehicle, wherein a vehicle is generally centered lengthwise on the center opening 21 and the outer slots 25 must be positioned beyond the ends of the vehicle to leave room for the canopy 40. The outer slots 25 are recessed within the vehicle lot 12 to not interfere with moving of the vehicles during non-use of the present invention. A hinge mechanism 26 is secured within each of the outer slots 25 and a securing element 27 extends from the hinge mechanism 26. The securing mechanism may be comprised of a plurality of configurations, such as a hook, pin, locking device, etc., all that are able to secure the respective wing 42 of the canopy 40 adjacent the outer slot 25.

The securing element 27 further secures the respective wing 42 near the ground surface to not allow hail or other weather elements to fall under the canopy 40 and hit the enclosed vehicle. During non-use, the securing element 27 pivots via the hinge mechanism 26 to within the outer slot 25 and below or level with the surface of the vehicle lot 12 so as to be out of the way of customers, moving vehicles, etc. During use, the securing element 27 pivots upwards and at least partially out of the slot to connect to the respective wing 42 of the canopy 40.

C. End Frames

The present invention includes at least a pair of end frames 30 positioned upon opposing longitudinal ends of the canopy 40 to connect the canopy 40 to the connecting stations 20 of the vehicle lot 12. It is appreciated that the present invention may include multiple frames positioned along the canopy 40 between the ends, such as in the middle or otherwise depending on the length of the canopy 40 and the needed support. The end frames 30 are comprised of a strong and durable material to withstand excessive winds and harsh weather elements while in use. The end frames 30 are also preferably substantially lightweight to be easily transported and stored between uses.

Each end frame 30 generally includes an elongated center post 32 to be secured within the center opening 21 of the connecting station 20. The center post 32 includes a threaded lower end 33 to threadably connect to the threaded center opening 21. Each center post 32 is also generally higher than the enclosed vehicle to allow for the canopy 40 to form a triangular shape over the vehicle, wherein the center post 32 forms the apex or highest point of the canopy 40.

Each end frame 30 also includes a pair of arms 35 pivotal near an upper end of the center post 32 for forming the triangular shaped configuration of the end frame 30 and canopy 40. The arms 35 are pivotally connected to each other or to the center post 32. The arms 35 are elongated to a sufficient distance to extend from the upper end of the center post 32 to at least a few feet in front of or behind the enclosed vehicle. The arms 35 may be comprised of tubular posts or various other configurations. Each arm 35 may further include a slot to receive the canopy 40, wherein the canopy 40 may be rolled-up within the arm 35 through the slot similar to window shades or other rolling type mechanisms.

Each end frame 30 also includes a pair of lower connectors 36 (e.g. rings, hooks, etc.) each extending from a respective arm 35 of the end frame 30 to be secured to the securing element 27 within the outer slot 25 of the vehicle lot 12. The lower connectors 36 extend from the outermost and lower end 44 of the arms 35. It is appreciated that other configurations of the end frame 30 may be suitable for the present invention, all that removably secure the canopy 40 to the vehicle lot 12 in a manner to keep the canopy 40 above the enclosed vehicle. The end frames 30 also include hooks 38 extending longitudinally along each arm 35 of the end frames to connect to an extended wing 42 of a canopy 40 of the adjacent end frame 30.

D. Canopy

The canopy 40 is comprised of a strong, durable and lightweight material to prevent hail or other heavy or damaging weather, etc. elements from damaging the vehicle beneath the canopy 40. The canopy 40 preferably extends completely over a longitudinal length of the vehicle in a triangular manner. The canopy 40 generally includes a pair of wings 42 extending downward from the region adjacent the upper end of the center post 32. The canopy 40 may be permanently connected or removably connected to the end frames 30.

The upper end 43 of each of the wings 42 meet at the apex of the canopy 40 and the lower end 44 extends at a downward angle toward a respective outer slot 25 and securing element 27. The wings 42 may be connected and integrally formed to provide a one-piece canopy 40 or may be separated and each extend along a respective arm 35 of the end frames 30.

The canopy 40 further is able to roll-up when storing the present invention, similar to a window blind or other rollable material. This allows the canopy 40 to be small in size during non-use for easy storage and transport and allows the canopy 40 to roll out during use towards a length that will extend across a plurality of vehicles. The rollable configuration also helps in preventing kinks or fold lines in the canopy 40 during a storage position. The canopy 40 may further include an actuating mechanism to assist in automatically rolling the canopy 40. The actuating mechanism may use various technologies similar to that used in rollable shades, or other mechanisms used to roll tarps or flexible sheets of material, such as a spring actuated roller or the like. Each wing 42 of the canopy 40 may further roll within a respective arm 35.

In the preferred embodiment, each wing includes connectors or handles 46 positioned upon an opposing end of the arm to connect to the hooks of another end frame 30. When rolling the wings 42 up within the arm (connected opposite the handles 46), the wing 42 is slightly pulled outward (similar to a window shade being pulled downward), and then slowly released to acute the actuating mechanism to roll the wing 42 within the arm 35.

The material of the canopy 40 may be comprised of various configurations to allow the canopy 40 to allow wind to pass through yet prevent hail, etc. from passing through and damaging the enclosed vehicle. One embodiment of the material of the canopy 40 is a spider web stitching over a plurality of small squares that comprise the canopy 40. Other designs may be appreciated that will produce similar results. The actual material of the canopy 40 may be comprised of ultra high weight polyethylene, braided fishing line, or others.

The canopy 40 is also generally long enough to cover at least 8-10 vehicles parked side by side, and may be manufactured in various other sizes to accommodate more or less vehicles. The canopy 40 may also be coated with a protective substance, such as antifreeze which would allow for use in colder temperatures and when large amounts of snowfall is expected. The protective substance may also allow for ease in retracting the material back towards one of the end frames 30 after use by increasing the flexibility of the material.

E. Operation of Preferred Embodiment

In use, when hazardous weather, such as hail, is expected, a first end frame 30 is secured to the connecting station 20 via connecting the center post 32 to the center opening 21, and extending the wings 42 outwards and connecting the lower connectors 36 of the arms 35 to the securing elements 27 of the outer slots 25. The canopy 40 is extended from the respective arm 35 via pulling on the handles 46 and unrolling the canopy 40 away from arm 35.

The handles 46 are secured to the facing hooks 38 of the adjacent end frame 30, wherein the adjacent end frame 30 is also ensured to be secured to a respective connecting station 20 to enclose the vehicles between the connecting stations 20 under the canopy 40 away from the hazardous weather. Adjacent canopies 40 may now be set up in a similar manner to enclose more vehicles.

After use, one end frame 30 is disconnected from the connecting station 20 and the canopy 40 is allowed to automatically roll-up towards the opposing connected end frame 30, which is then disconnected. The wings 42 are folded adjacent the center post 32 and the present invention may be easily transported and stored.

What has been described and illustrated herein is a preferred embodiment of the invention along with some of its variations. The terms, descriptions and figures used herein are set forth by way of illustration only and are not meant as limitations. Those skilled in the art will recognize that many variations are possible within the spirit and scope of the invention, which is intended to be defined by the following claims (and their equivalents) in which all terms are meant in their broadest reasonable sense unless otherwise indicated. Any headings utilized within the description are for convenience only and have no legal or limiting effect.

I claim:

1. A covering system for one or more vehicles, comprising:

a pair of connecting stations permanently embedded below a ground surface of a vehicle lot, wherein said pair of connecting stations are aligned with each other and distally separated;

a pair of end frames connected to said pair of connecting stations;

a canopy interposed between said pair of end frames, wherein said canopy is connected to said pair of connecting stations via said pair of end frames;

wherein said canopy is retracted within one of said pair of end frames;

wherein said canopy includes a pair of wings foldably connected near an apex of said canopy to form a triangular shaped configuration; and at least one vehicle sheltered beneath said canopy.

2. The covering system of claim 1, wherein said pair of end frames each include a center post.

3. The covering system of claim 2, wherein said pair of connecting stations each include a center opening for receiving said center post.

4. The covering system of claim 3, wherein said center opening is threadably formed to threadably receives said center post.

5. The covering system of claim 1, wherein said pair of end frames each include a pair of lower connectors extending from a pair of arms.

6. The covering system of claim 5, wherein said pair of connecting stations each include a pair of securing elements to connect to said pair of lower connectors.

7. The covering system of claim 6, wherein said pair of securing elements are positioned upon opposite sides of said canopy.

8. The covering system of claim 6, wherein said pair of securing elements are comprised of a hook configuration.

9. The covering system of claim 6, wherein said pair of securing elements are pivotally connected to said pair of connecting stations.

10. The covering system of claim 9, wherein said pair of securing elements include a first position and a second position, wherein said pair of securing elements in said first position are below said ground surface of a vehicle lot and wherein said pair of securing elements in said second position extend at least partially above said ground surface of said vehicle lot, wherein said pair of securing elements pivot from said first position to said second position.

11. The covering system of claim 10, wherein said pair of connecting stations each include a pair of slots, wherein said pair of securing elements are positioned within said pair of slots in said first position.

12. The covering system of claim 1, wherein said canopy includes an actuating mechanism to automatically retract said canopy in a rollable manner.

13. The covering system of claim 1, wherein said canopy is stitched in a spider web shaped configuration.

14. The covering system of claim 1, wherein said pair of end frames include a plurality of hooks to connect to an adjacent canopy.

15. A covering system, comprising:

a pair of connecting stations embedded below a ground surface, wherein said pair of connecting stations are aligned with each other and distally separated;

wherein said pair of connecting stations each includes a center opening and a pair of securing elements;

wherein said pair of securing elements include a first position and a second position, wherein said pair of securing elements in said first position are below said ground surface and wherein said pair of securing elements in said second position extend at least partially above said ground surface, wherein said pair of securing elements pivot from said first position to said second position;

a pair of end frames connected to said pair of connecting stations;

wherein said pair of end frames each include a center post connected to said center opening and a pair of arms, wherein said pair of arms are pivotally connected to said center post along an upper end of said pair of arms and wherein said pair of arms include a pair of lower connectors connected to said pair of securing elements; and a canopy interposed between said pair of end frames;

wherein said canopy is comprised of a triangular shaped configuration, wherein said canopy is secured to said pair of connection stations near an apex by said center post and near a pair of outer ends by said pair of arms and said pair of lower connectors.

16. The covering system of claim 15, wherein said center opening is threadably formed to threadably receives said center post.

17. The covering system of claim 15, wherein said pair of connecting stations each include a pair of slots, wherein said pair of securing elements are positioned within said pair of slots in said first position.

18. A multiple car covering system, comprising:

a pair of connecting stations embedded below a ground surface of a vehicle lot, wherein said pair of connecting stations are aligned with each other and distally separated;

wherein said pair of connecting stations each includes a threadable center opening and a pair of pivotal securing elements;

a pair of end frames connected to said pair of connecting stations;

wherein said pair of end frames each include a center post connected to said center opening, a pair of arms pivotally connected at an upper end of said center post and a pair of lower connectors extending from said pair of arms and connected to said pair of securing elements;

wherein said pair of securing elements include a first position and a second position, wherein said pair of securing elements in said first position are below said ground surface of said vehicle lot and wherein said pair of securing elements in said second position extend at least partially above said ground surface of said vehicle lot;

wherein said pair of connecting stations each include a pair of slots, wherein said pair of securing elements are positioned within said pair of slots in said first position; and a canopy interposed between said pair of end frames;

wherein said canopy is comprised of a triangular shaped configuration, wherein said canopy is secured to said pair of connection stations near an apex by said center post and near a pair of outer ends by said pair of lower connectors;

wherein said canopy includes an actuating mechanism to automatically retract said canopy in a rollable manner;

wherein said canopy is retracted within one of said pair of end frames;

wherein said pair of end frames include a plurality of hooks to connect to an adjacent canopy.

* * * * *